United States Patent [19]

Bremer et al.

[11] Patent Number: 4,840,362

[45] Date of Patent: Jun. 20, 1989

[54] APPARATUS FOR POSITIONING AND SUPPORTING A PATIENT FOR SPINAL SURGERY

[75] Inventors: Ross L. Bremer, 1502 Beach Ave., Atlantic Beach, Fla. 32233; Howard P. Hogshead, Jacksonville, Fla.

[73] Assignee: Ross L. Bremer, Atlantic Beach, Fla.

[21] Appl. No.: 152,225

[22] Filed: Feb. 4, 1988

[51] Int. Cl.[4] ..... A61G 13/00

[52] U.S. Cl. ..... 269/328; 5/437; 5/446

[58] Field of Search ..... 269/322, 328; 5/82 R, 5/431, 436, 437, 440, 446, 465

[56] References Cited

U.S. PATENT DOCUMENTS

| | | | |
|---|---|---|---|
| 2,700,779 | 2/1955 | Tolkawsky | 5/436 |
| 2,764,150 | 9/1956 | Ettinger et al. | 269/328 |
| 3,828,377 | 8/1974 | Eary, Sr. | 269/328 |
| 3,987,507 | 10/1976 | Hall | 5/437 |
| 4,398,707 | 8/1983 | Clouard | 269/328 |
| 4,535,495 | 8/1985 | Oldfield | 5/436 |

*Primary Examiner*—Frederick R. Schmidt
*Assistant Examiner*—Judy J. Hartman
*Attorney, Agent, or Firm*—Nixon & Vanderhye

[57] ABSTRACT

Disclosed is a kit of resilient blocks and an assemblage thereof for positioning and supporting a patient for spinal surgery. The blocks have hook and loop fasteners for securing them in the assemblage in their required positions. The blocks are shaped and dimensioned for different patient sizes and different curvatures of the patient's spine so that the assemblage of blocks may be customized to the individual patient's size and shape and the requirements of the surgery. The blocks include a base block, a U-shaped block, inside and outside filler blocks, face and chest blocks, and a pair each of flexion, lordosis or neutral blocks. The nature of the surgical procedure and the size and shape of the patient determine the size and identity of the blocks to be used. The base board and blocks are radiolucent so that X-ray fluorescence may be performed during the surgical procedure both P/A and laterally.

30 Claims, 5 Drawing Sheets

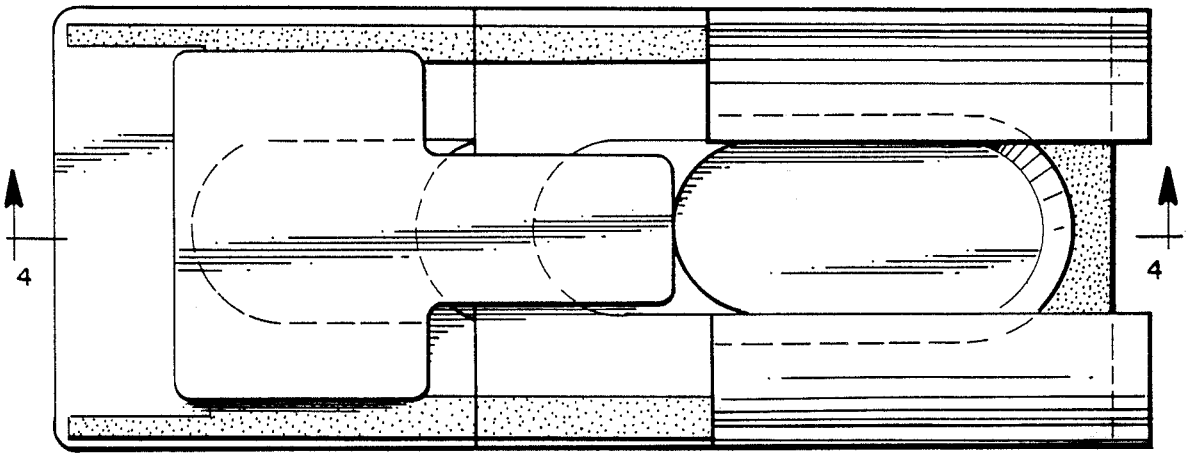
FIG. 3
FIG. 4
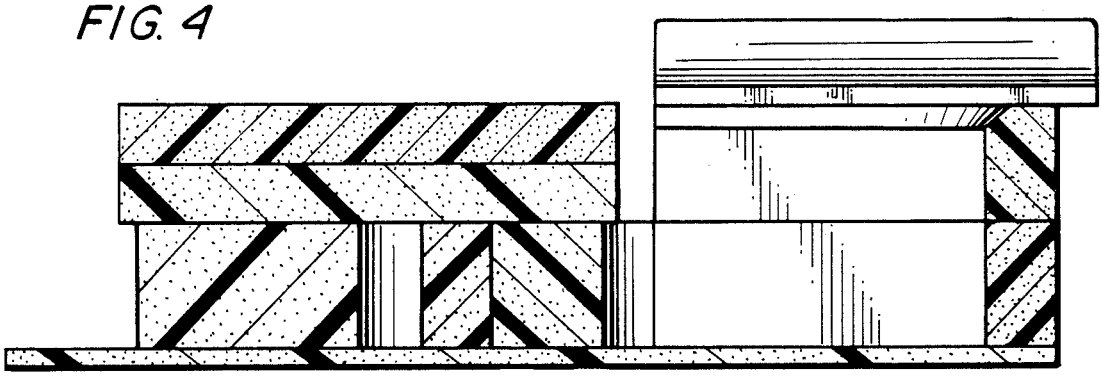
FIG. 5a
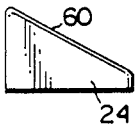
FIG. 5b
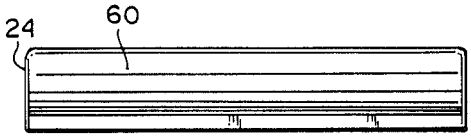
FIG. 5c
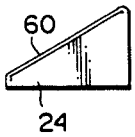

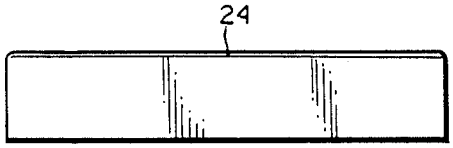
FIG. 5d
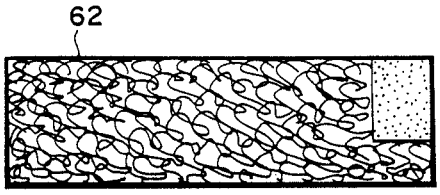
FIG. 5e
FIG. 6a
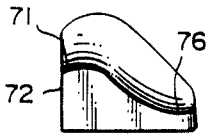
FIG. 6b
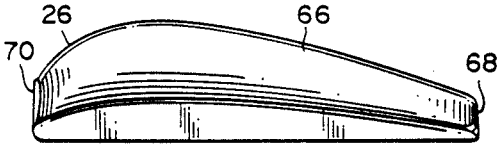
FIG. 6c
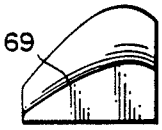
FIG. 6d
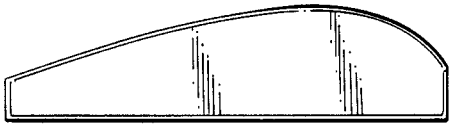
FIG. 6e
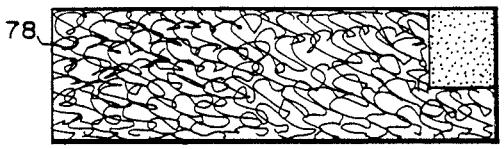
FIG. 7a
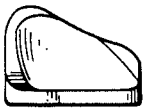
FIG. 7b
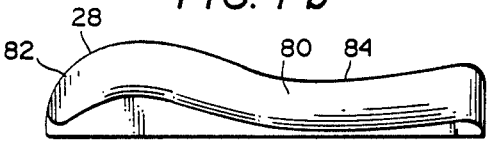
FIG. 7c
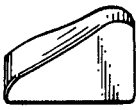
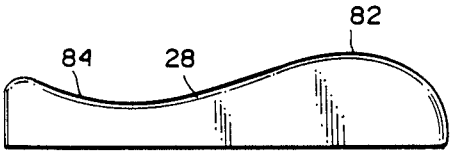
FIG. 7d
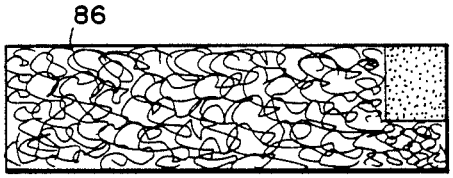
FIG. 7e FIG. 8
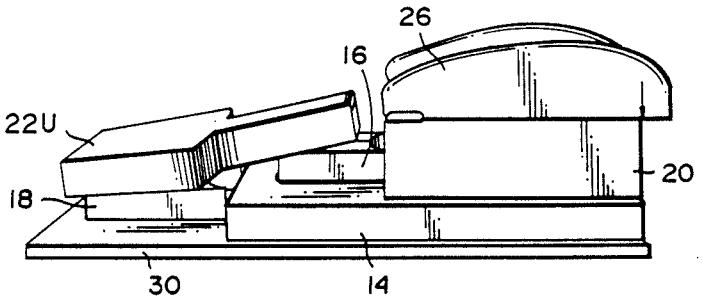
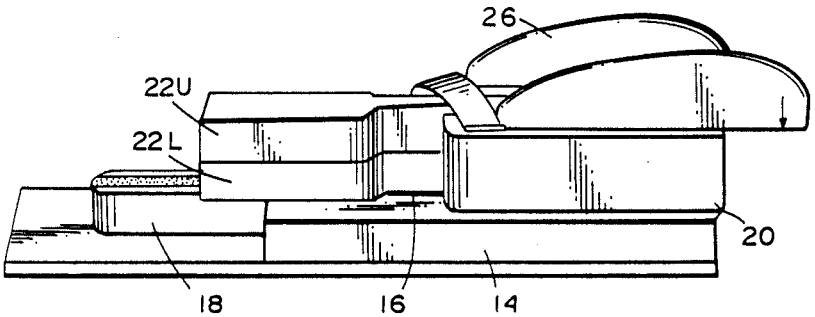
FIG. 9
FIG. 10
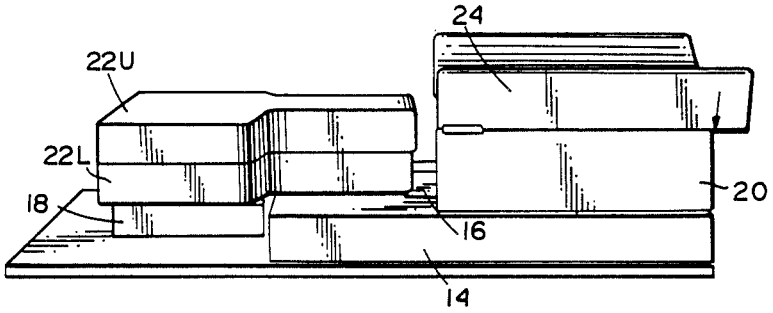

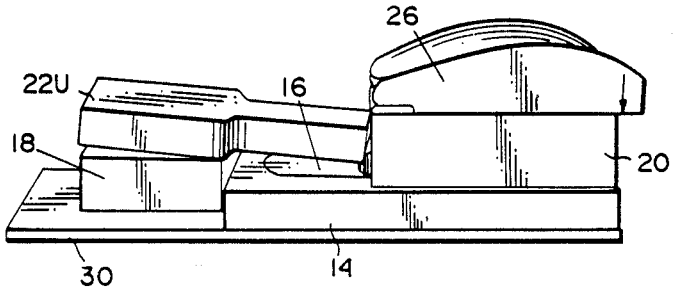
FIG. 11
FIG. 12
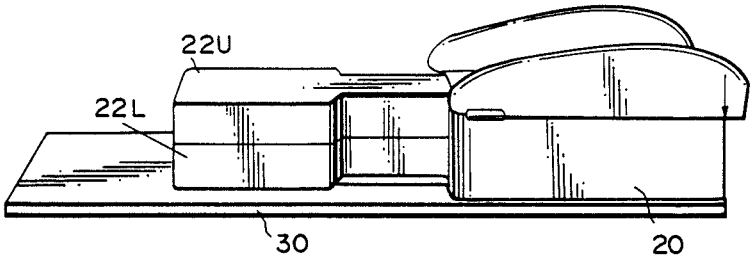

APPARATUS FOR POSITIONING AND SUPPORTING A PATIENT FOR SPINAL SURGERY

BACKGROUND OF THE INVENTION

The present invention relates generally to a kit of resilient blocks specifically configured, when arranged in assembled condition, to properly position and support a patient's spine for surgical procedures and allow free passage of X-rays for visualization. The present invention also relates to an assemblage of blocks releasably secured one to the other in position for supporting a patient in any one of flexion, neutral and extension positions for spinal surgical procedures.

In U.S. Pat. No. 4,398,707, there is disclosed a surgical saddle for positioning and supporting a patient for spinal surgery. In that system, a base pad formed of soft foam rubber is provided with a tapered head extension formed of a similar material. A leg portion, also constructed of soft foam rubber, extends from the opposite end of the base. A pair of laterally spaced ridges are adhesively secured on top of the base portion along its opposite sides for support of the iliac crests of the patient's pelvic bone such that the patient's abdomen and diaphragm hang freely without compression against the spinal area. One of the purposes of that invention consonant with the present invention is to preclude engorgement of interspinal blood vessels to minimize loss of blood during the spinal operation.

However, the system disclosed in that patent does not accommodate patients of different sizes or patients having various conditions of the lumbar spine, such as lordosis. flexion or neutral. For example, a surgeon may wish to position the patient's spine in flexion for a laminectomy such that the intervertebral spaces open up. Another surgeon, however, may wish the patient to be in a lordotic position. The saddle of the previously mentioned U.S. patent cannot accommodate patients of various sizes and shapes including deformities, as well as place the patient in the various required lumbar positions, i.e., the lordosis, flexion or neutral positions. Nor may this device allow for passage of X-rays for visualization.

According to the present invention, there is provided reusable surgical positioning and support apparatus comprised of a plurality of reusable resilient blocks formed to specific shapes and dimensions which, in assembly, properly support a patient's spine for surgical procedures, while allowing the abdomen and diaphragm to hang freely without compression, eliminating interspinal venous engorgement. Certain of the blocks may be alternated to allow positioning in the assemblage in any of flexion neutral and extension positions, while positioning the patient for spinal surgery. The blocks are preferably formed of an elastomer foam having a vinyl-coated outer surface whereby they may be sterilized for reuse. Additionally, the blocks carry hook or loop fasteners at various locations along the blocks such that the blocks may be interconnected one with the other to form the desired shape of the assemblage.

To enable the positioning and support apparatus hereof to accommodate the different sizes and forms of patients, the primary blocks of the kit include a base block (although the base block may be omitted in very small patients), U-shaped block, inside and outside filler blocks, face and chest blocks, and a pair each of flexion, lordosis and neutral blocks, as described in detail hereinafter. These primary blocks may be provided in various dimensions or numbers thereof as applicable for use in combination with one another and other blocks. Thus, the configuration and location of the blocks, and their selection in conjunction with their dimensional relationships, may be used to form an assemblage of interconnected blocks in a predetermined desired configuration to accommodate patients of different size and shape, including patients with deformities, as well as simultaneously affording positioning of the lumbar region for that particular surgery. The assemblage of blocks is preferably mounted on an elongated rigid base board and secured thereto by hook and loop fasteners. The base board may be secured, e.g., by taping, to a standard operating room table "C" arm extensions. In this manner, the patient may be positioned as desired in accordance with the particular surgery to be performed and with the size of the patient.

More particularly, the present invention provides a kit of resilient building blocks for forming the positioning and supporting assemblage. Particularly, a base block is provided having a central opening. The underside of the base block is provided with pile material for connection with hook fasteners provided on the upper side of a rigid base board. Inner and outer filler blocks are provided and each has hook and pile fasteners along its upper and lower sides, respectively. The inner filler block is disposed at one end of the opening through the base block while the outside filler block forms an endwise extension of the base block. Both filler blocks, together with an end portion of the base block, provide support for the superposed face and chest block. Two partial, generally T-shaped, face and chest blocks are preferably provided as part of the kit. One of the face and chest blocks has hook and loop fasteners on its upper and lower faces, respectively, i.e., a lower face and chest block, while the other has only pile on its lower face, i.e., an upper face and chest block. In this manner, the upper or both the upper and lower face and chest blocks may be used in superposition over the filler blocks. A U-shaped block is secured on top of the base block by hook and pile fasteners, the leg of the T-shaped block(s) facing the opening of the U-shaped block. A strap is secured across the legs of the U-shaped block adjacent its open end to assist in maintaining the legs generally parallel one to the other in use and to prevent the legs from spreading in use.

A pair of blocks are disposed on opposite sides of the U-shaped block overlying the side legs thereof. The upper surfaces of these blocks are inclined downwardly toward one another in assembly and provide support for the patient's iliac crests and ribcage. Hook and pile fasteners are used to secure the pair of blocks to the U-shaped block. The kit includes three pairs of such blocks which are selectively used depending upon the desired patient position, i.e., lordosis, neutral or flexion. Thus, the shape of the upper surfaces of the block is specifically designed to effect a certain positioning of the patient's spine as required by the surgeon. For example, the upper surface of the lordosis pair of blocks have convex and concave arcuate portions spaced longitudinally one from the other to dispose the patient in a lordotic position. The pair of flexion blocks has a single convex surface extending from one end to the other to extend the patient's spine. The pair of neutral blocks have a linearly extending upper surface.

The base block and inside and outside filler blocks, are provided in one of two thicknesses or depth dimensions, although additional blocks may be provided in the dimensions as desired. For example, the base block and filler blocks may be provided in 2-inch or 4-inch thicknesses, and blocks of those dimensions are selectively used depending upon the size of the patient. For example, a 2-inch base block would be used for a patient having a height of 5'6" or less, whereas the 4-inch base block would be used for a taller patient. Either the 2-inch or 4-inch filler blocks may be used with either of the 2-inch or 4-inch base blocks depending upon the particular size and shape of the patient. Likewise, one or more of the face and chest blocks may also be used depending upon the particular size and shape of the patient. Consequently, the present invention provides a versatile kit and an assemblage of blocks for both positioning and supporting a patient for spinal surgery and which blocks are adaptable to support patients of different sizes and shapes and to position patients depending upon the desired orientation of the spine for surgery while still allowing unobstructed X-ray visualization of the spine.

Accordingly, in accordance with a preferred embodiment of the present invention, there is provided an assemblage for positioning and supporting a surgical patient facedown, comprising a generally rectangular base block formed of resilient material having length, width and depth dimensions and a central opening, a generally elongated U-shaped block formed of resilient material having a base and a pair of leg portions extending from the base defining a central opening and length, width and depth dimensions, means for releasably securing the U-shaped block and the base block one to the other with the U-shaped block superposed on the base block and the openings in registration one with the other, a face and chest block formed of resilient material superposed at least in part on the base block adjacent the end of the U-shaped block remote from the base for receiving the face and chest of the patient, a pair of elongated blocks formed of resilient material superposed on the legs of the U-shaped blocks to define a space laterally therebetween in registry with the openings in the U-shaped block and the base block, each of the pair of blocks having an upper surface inclined generally inwardly and downwardly toward one another whereby the abdomen and diaphragm of the patient may depend freely in a direction toward the spaces and openings and means for releasably securing the pair of blocks and the U-shaped block one to the other.

According to another aspect of the present invention, there is also provided a kit for assembling surgical support and positioning apparatus for a surgical patient, comprising a generally rectangular base block formed of resilient material having length, width and depth dimensions and a central opening, a generally elongated U-shaped block formed of resilient material and having a base and a pair of leg portions extending from the base, the U-shaped block having length, width and depth dimensions, means carried by at least one of the base block and the U-shaped block for releasably securing the base block and the U-shaped block one to the other, with the U-shaped block in superposition relative to the base block, a face and chest block formed of resilient material for superposition at least in part on the base block adjacent the end of the U-shaped block remote from the base block for receiving the face and chest of the patient, a pair of elongated blocks formed of resilient materials for superposition on the legs of the U-shaped block to define a space laterally therebetween in registry with the openings of the U-shaped block and the base block, each of the pair of blocks having an upper surface inclined generally inwardly and downwardly toward one another when superposed on the U-shaped block and means carried by one of the U-shaped block and the pair of blocks for releasably securing the pair of blocks and the U-shaped block one to the other.

Accordingly, it is a primary object of the present invention to provide a novel and improved kit and an assemblage of resilient blocks for positioning and supporting a patient for spinal surgery which accommodates patients of different sizes and shapes and the surgeon's requirement for different positions of the patient's spine presented for spinal surgery while enabling X-ray visualization of the spinal region during the surgical procedure.

These and further objects and advantages of the present invention will become more apparent upon reference to the following specification, appended claims and drawings.

BRIEF DESCRIPTION OF THE DRAWING FIGURES

FIG. 3 is a enlarged plan view of the assemblage illustrated in FIG. 1;

FIG. 4 is a cross-sectional view thereof taken generally about one line 4—4 in FIG. 3;

Figure 1:
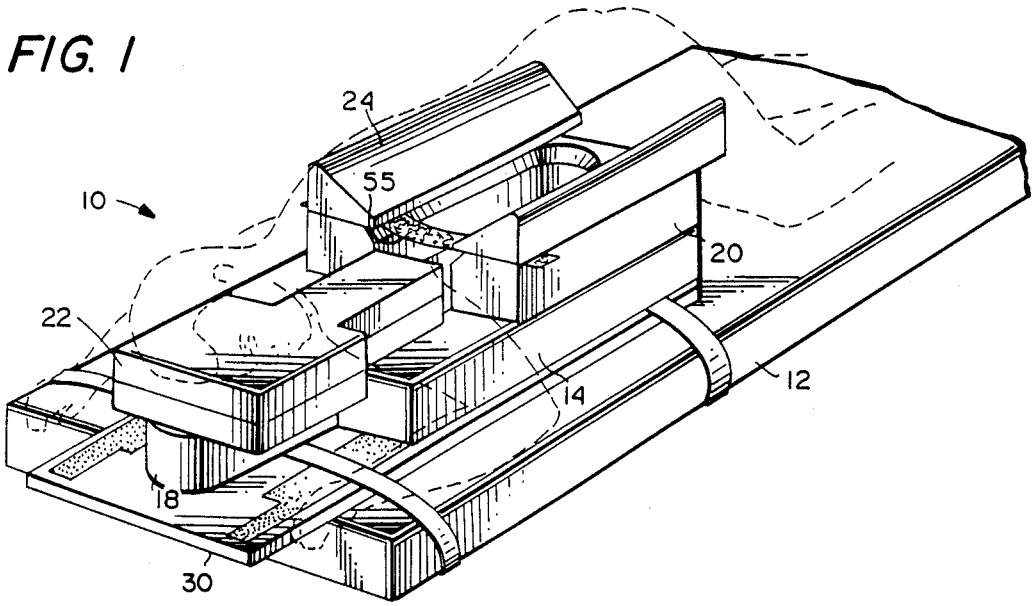
FIG. 1 is a perspective view of an assemblage of blocks, constructed in accordance with the present invention, illustrated on a rigid base board, in turn, disposed on an operating table, a patient being illustrated by the dashed lines in operable position on the assemblage.

FIGS. 5*a*, 5*b*, 5*c*, 5*d* and 5*e* are left end elevational, inside front elevational, right end elevational, rear elevational and bottom plan views, respectively, of one of the pair of neutral blocks provided as part of the kit and assemblage;

FIGS. 6*a*, 6*b*, 6*c*, 6*d* and 6*e* are left end elevational, inside front elevational, right end elevational, rear elevational and bottom plan views, respectively, of one of the pair of flexion blocks provided as part of the kit and assemblage;

FIGS. 7*a*, 7*b*, 7*c*, 7*d* and 7*e* are left end elevational, inside front elevational, right end elevational, rear elevational and bottom plan views of one of the pair of lordosis blocks provided as part of the kit and assemblage; and FIGS. 8–12 are perspective views of various assemblages of the blocks hereof for patients of different sizes and for different surgical needs.

DETAILED DESCRIPTION OF THE DRAWING FIGURES

Reference will now be made in detail to the present preferred embodiment of the invention, an example of which is illustrated in the accompanying drawings.

Referring now to the drawings, particularly to FIG. 1, there is illustrated an assemblage, generally designated 10, of resilient blocks for positioning and supporting a patient on an operating table 12 for spinal surgery. The blocks in the assemblage are identified initially as follows: a base block 14, an inside filler block 16 (FIG.

Figure 2:
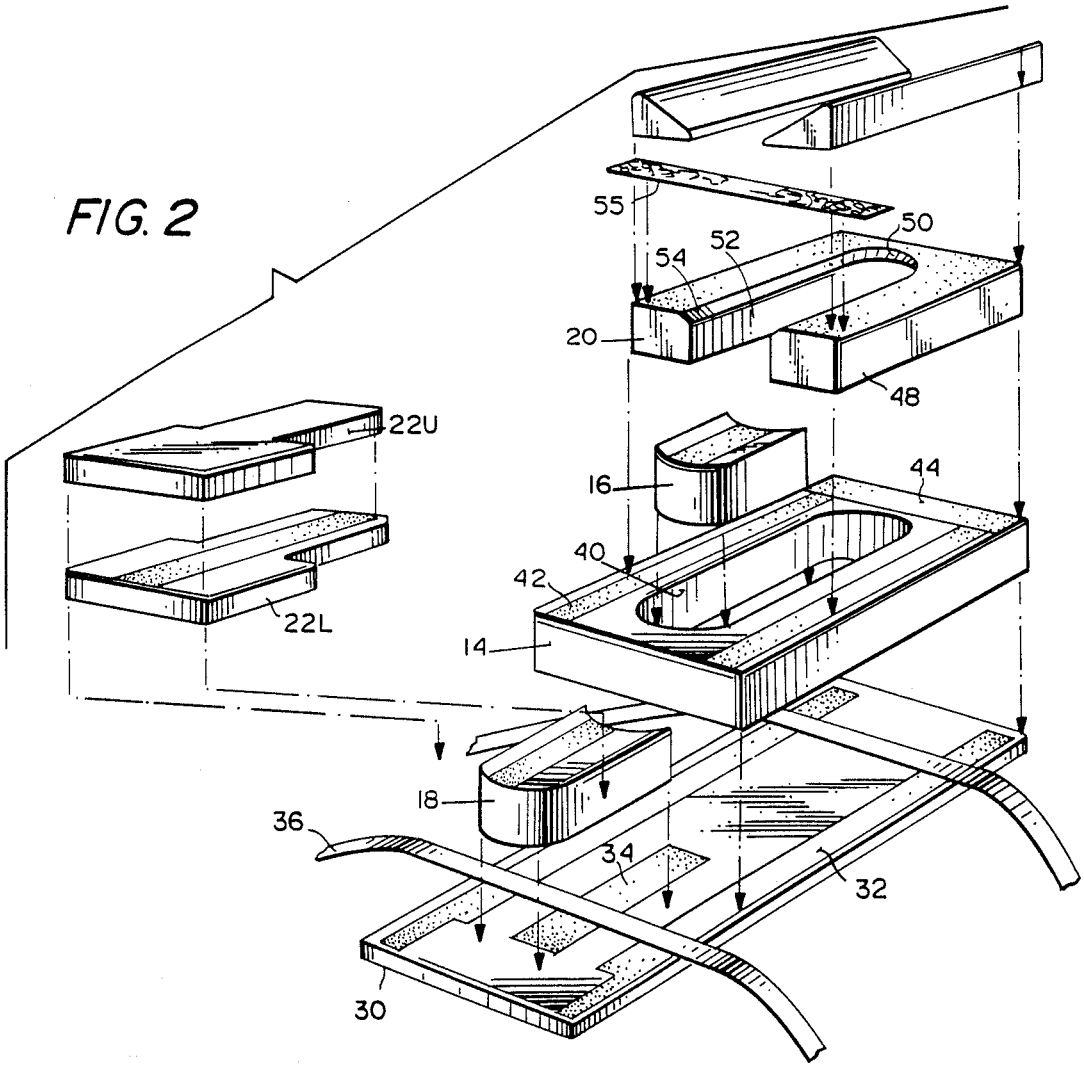
FIG. 2 is an exploded perspective view of the assemblage illustrated in FIG. 1.

2), an outside filler block 18, a U-shaped block 20, a pair of face and chest blocks 22, and a pair of neutral blocks 24, it being appreciated that either one of a pair of flexion blocks 26 as illustrated in FIGS. *6a–6e*, or a pair of lordosis blocks 28 illustrated in FIGS. *7a–7e*, may be used in the assemblage in lieu of the neutral blocks 24. The assemblage is mounted on a base 30. Preferably, base 30 comprises an elongated, rigid board, preferably formed of Lexan. On the upper surface of the board there is provided hook fastener portions 32 of hook and pile fasteners. Hook fastener portions 32 are provided in strip form along opposite sides of board 30. A short strip of hook fasteners 34 also upstand from a central portion of the board adjacent its forward end. As illustrated in FIGS. 1 and 2, straps 36, for example tape, may be used to secure the opposite ends of board 30 to operating table 12.

As will be appreciated from the ensuing description, each of the blocks to be described has the loop or pile portion of hook and loop fasteners formed along its underside for securing the block to the underlying block or board as will be apparent. Each block, except for the upper face and chest block 22U, and the pairs of lordosis, flexion and neutral blocks, have the hook portions of the hook and pile fasteners facing upwardly for engagement with the downwardly facing pile fastener portions of the superposed blocks.

Turning now particularly to FIG. 2, base block 14 is generally rectangular, having length, width and depth dimensions, and a central opening 40 in the shape of an oval. As indicated in FIG. 2, the side margins along the upper face of base bock 14 have hook portions 42 of hook and pile fasteners and an additional strip of hook portions 44 extend along one end of the base block 14. It will be appreciated from the foregoing that strips of corresponding loop or pile fastener portions are secured along the underside of the base block 14 in similar positions for securement with the upwardly facing hook portions 32 carried by board 30.

Inside and outside filler blocks 16 and 18 are formed, generally similar in shape in plan one to the other. That is, both filler blocks 16 and 18 are elongated and have convex and concave portions at their respective opposite ends. Central strips of hook and pile fastener portions are disposed along their upper and lower surfaces, respectively. In this manner, when the inside filler block 16 is disposed within central opening 40 of the base block, its downwardly facing pile fastener portions engage the upwardly facing hook fastener portions 34 of base board 30. Likewise, when the outside filler block 18 is disposed at one end of base block 14, the downwardly facing loop or pile fastener portion engages the upwardly facing hook fastener portions 34 of board 30.

U-shaped block 20 is elongated and has a pair of side legs 4B and a base portion 50. The central opening 52 of the U-shaped block opens through the forward end thereof in a direction toward the outside filler block 18. The upper inside marginal edge defining the central opening 52 is beveled or inclined inwardly and downwardly at 54 to facilitate downward extension of the diaphragm and abdomen of the patient. As illustrated, the entire upper surface of the U-shaped block 20, with the exception of bevel 54, is provided with hook fasteners and its underside, not shown, is provided with loop or pile fasteners for securing U-shaped block 20 in superposition to base block 14. A strap 55 having pile fastener material along both sides is provided for securement across the open end of U-block 20 formed by the laterally spaced legs 48 in a manner described more particularly hereinafter.

Each of face and chest blocks 22U and 22L has a generally elongated T-shaped configuration. The upper surface of the lower face and chest block 22L in the assemblage is provided with a strip of hook fasteners, while the undersurface of both face and chest blocks 22U and 22L have loop or pile fastener strips. Thus, the lower face and chest block 22L may bridge the forward end of base block 14 and be secured in superposed position over both outside and inside filler blocks 18 by engagement of the hook and loop fasteners. The upper face and chest block 22U may be superposed over the lower face and chest block 22L and secured thereto by the hook and pile fasteners. This leaves the upper surface of face and chest block 22U free of any fastener-type material. The face and chest blocks are generally T-shaped to facilitate depression of the shoulders of the patient and a resting surface for the patient's head, which will face to one side or the other of the face and chest blocks when the patient is in the appropriate surgical position.

Referring now to FIG. 2 in conjunction with FIGS. *5a–5e*, the pair of neutral blocks 24 will now be described. Each neutral block is elongated, having the general shape of a triangle in cross-section at each longitudinal position therealong. The flat upper surface 60 of each neutral block 24 inclines inwardly and downwardly toward the other block 24 when in the assemblage illustrated in FIGS. 1 and 2. As will be appreciated from a review of drawing FIGS. *5a* through *5e*, the width dimension of blocks 24 is greater than the depth or height dimension. Loop or pile fastener portions 62 are provided along the entirety of the undersurface of the blocks 24 whereby they may be fastened by hook and pile fasteners to the upper side of U-shaped block 48.

Referring now to FIGS. *6a–6e*, a flexion block 26 is illustrated. As with neutral blocks 24, each flexion block 26 has a shaped upper surface 66. However, the upper surface 66 of flexion block 26 inclines inwardly and downwardly toward its opposite flexion block when in the assemblage illustrated in FIG. 2. Block surface 66 also curves in a generally convex fashion in the longitudinal direction from its forward end 68 to its rear end 70. At the forward end 68, the upper surface is generally convex in cross-section at 69. At the rear end 70, surface 66 is convex in cross-section at 71 adjacent its outer side 72 and concave at 76 along its inside edge, the surfaces 72, 76 generally merging into surface 69 along the length of the block. It will also be appreciated that flexion block 26 is higher in elevation adjacent its rear end 70 and lower in elevation adjacent forward end 68. As with the neutral blocks 24, the undersurface of the flexion block 26 illustrated in FIG. *6e* is provided with loop or pile fastener material 78.

Referring now to the lordosis block 28 illustrated in FIGS. *7a–7e*, the upper surface 80 is inclined downwardly and inwardly toward the opposite block when the blocks 28 are in the assemblage illustrated in FIG. 2. Upper surface 80 has a compound curve in the longitudinal direction. Particularly, at the rearward end of the block, the inclined surface 80 is convex at 82 and extends forwardly, where the curvature is reversed, to provide an upwardly directed concave surface 84. The highest elevation of the lordosis block 28 is at the apex of the convex surface portion 82, the concave surface portion 84 terminating at the forward end at an elevation below the elevation of the apex of the highest convex surface portion. As illustrated in FIG. 7*e*, the lower or undersurface of the lordosis blocks have loop or pile material 86 for engagement with the hook material on the upper surface of U-block 20.

The neutral, flexion and lordosis blocks hereof are provided in pairs in the kit. Each block of each pair, when in the assemblage, is the mirror image of the other block of that pair of blocks on the opposite side of the longitudinal centerline of the assemblage. Also, each of the resilient blocks disclosed herein is formed of an elastomer foam having a vinyl coating such that the blocks can be sterilized for reuse. The resiliency of the blocks is about 20–40 durometer. Further, each block of each pair of neutral, lordosis and flexion blocks has along its undersurface a patch of hook fastener portions adjacent its forward corner. As will be appreciated from the ensuing description, those patches engage the strap 55 extended over the legs of the U-block 20.

In a preferred form of the present invention, the Lexan mounting base is 38 inches long, 15 inches wide and has a depth of ½ inch. Two base blocks 14 are provided as part of the kit. One of the base blocks has a length of 23 inches, a width of 15 inches and a height of 4 inches. The oval shaped opening 40 has a length of about 18 inches. The width of the opening 40 in the base block 14 is 6 inches. The other base block is provided with similar length and width dimensions, but its depth dimension is 2 inches. Similarly, two different sizes of outside filler blocks are provided. Both filler blocks have a length of 10 inches and a width of 6 inches but one has a depth of 2 inches while the other has a depth of 4 inches. Likewise, the two inside filler blocks have a length and width of 6 inches, while one block has a depth of 2 inches and the other 4 inches. The U-shaped block has length and width dimensions of 14.5 and 15 inches, respectively. The U-shaped block is 4 inches in depth, and its central opening is 6 inches wide. Two foam face and chest blocks 22 are provided. Each block has an overall length of 18 inches, a 5-inch width at the small end of the block, a 12-inch width at the large end of the block and a depth of 2 inches. The lordosis, flexion and neutral blocks are each 16 inches long and 4.5 inches wide. The highest elevation of the convex surface of the lordosis block is 3.5 inches, while at the forward end of the block, the elevation is 2.5 inches. For the flexion block, the highest elevation is 4 inches and the neutral block has a height of 3 inches.

In using the system hereof, the height of the individual is first ascertained. If the patient's height is less than 5'6", the 2-inch blocks are used, whereas if the height of the individual is greater than 5'6", the 4-inch blocks are used. Additionally, the surgeon ascertains the position of the spine necessary for the operation to be performed and, based on that, determines which of the three pairs of lordosis, flexion or neutral blocks will be used in the assemblage. Once these conditions are ascertained, the assemblage of the blocks can go forward.

Straps are disposed across the base. For example, such straps may have pile material on their undersurfaces for engagement with the hooks of the upper surface of the base or they may comprise adhesive tape. The purpose of the straps is to secure the board and assemblage to the operating table. The base block 14 is then disposed such that its rear or base end aligns with the end of base board 30 opposite the hook material 34. The base block 14 is mounted on the board simply by pressing it downwardly to engage the hook and loop material. The appropriate inside and outside filler blocks 16 and 18 are applied in the positions illustrated. Depending upon the particular curvature of the patient's spine, either 2-inch or 4-inch blocks will be used with either of the 2-inch or 4-inch base blocks 14. Outside filler block 18 is secured by pressing it down onto the upstanding hooks 34. The inside filler block 16 is similarly secured. U-block 20 is then disposed on top of base block 14 with the hook and loop fasteners in engagement one with the other, the base 50 of U-block 20 overlying the base of base block 14. The strap 55 is then laid across the upper surface of U-block 20 adjacent its open end formed by legs 48. The pile fastener material along its underside engages the hook material along the upper surface of the leg ends to preclude spreading the legs 48 of U-block 20 laterally away from one another.

One or both of the face and chest blocks 22U and 22L are then applied in overlying relation to the outside filler block 18, with the leg of the generally T-shaped face and chest block extending longitudinally to overlie the forward end of the base block and inside filler block 16. Where only one face and chest block is used, the block 22U having only loop fasteners on its underside is used such that the upper surface of the block is free of any fastening material. If two blocks 22U and 22L are used, then face and chest block 22U overlies block 22L.

The selected lordosis, flexion or neutral blocks are then applied. In FIG. 2, the neutral blocks are applied by pressing them against the upper surfaces of the U-block 20 to engage the hook and loop material. The hook fastener portions at the forward ends of these blocks engage the pile fastener portion on the upper side of strap 55. The rear ends of blocks 24 extend slightly rearwardly of the end of the U-block 20 to enable a smooth transition of pressure from the anterior iliac spine to the upper thigh without undue pressure on the femoral nerve. If the lordosis or flexion blocks are used, it will be appreciated that the higher elevation portions of those blocks are located adjacent the rearmost portion of the assemblage. The entire assemblage may then be secured to the operating table if it has not already been secured thereto.

The patient may then be positioned facedown on the assemblage with the patient's head resting on the face and chest block 22U. Thus, the patient's diaphragm and abdomen lie in vertical registration with the openings between the pair of blocks 24, 26 or 28, the U-shaped block 20 and base block 14. Consequently, the patient is in position for the intended surgery.

In FIGS. 1–4, there is illustrated a block assemblage useful for a large adult using the 4-inch base and filler blocks, both T-shaped had and chest blocks, the U-shaped block and a pair of neutral blocks, it being appreciated that the neutral blocks could be replaced by one of the pairs of lordosis or flexion blocks depending upon the surgeon's need and the patient's anatomy. A large number of various combinations of blocks may be assembled to accommodate various patient positions and anatomical shapes, the surgeon's needs and the overall size of the patient. FIGS. 8–12 illustrate representative examples of the various combinations of assemblages, it being appreciated that other additional assemblages may be provided as desired.

In FIG. 8, there is illustrated an assemblage of blocks useful for a small adult (under 5 feet, 6 inches) where it is desirable to flex the patient's neck. In this assemblage, a 2-inch base block 14, a 2-inch and a 4-inch outside and inside filler blocks 18 and 16, respectively, a single 2-inch face and chest block 22U, the U-block 20, and a pair of flexion blocks 26 are used. The neutral or lordosis blocks 24 or 28, respectively, may be substituted for the pair of flexion blocks 26.

In FIG. 9, there is illustrated an assemblage for a small adult comprised of a 2-inch base block 14, 2-inch outside and inside filler blocks 18 and 16, respectively, the U-block 20, a pair of face and chest blocks 22L and 22U, and a pair of flexion blocks 26.

In FIG. 10, there is illustrated an assemblage for a small adult comprised of a 2-inch base block 14, 2-inch outside and inside filler blocks 18 and 16, respectively, a pair of face and chest blocks 22L and 22U, the U-block 20, and a pair of neutral blocks 24.

In FIG. 11, there is illustrated an assemblage for a small adult comprised of a 2-inch base block 14, a 4-inch outside filler block 18, a 2-inch inside filler block 16, one face and chest block 22U, the U-block 20 and a pair of flexion blocks 26. This latter assemblage hyperextends the head and back.

In FIG. 12, there is illustrated an assemblage for a child including a U-block 20, a pair of face and chest blocks 22L and 22U and a pair of flexion blocks 26. In this form, the U-block 20 and face and chest block 22L are secured directly to the base board 30 without an underlying base block 14.

It will be appreciated that various other assemblies of blocks may be provided depending on the needs of the surgeon and patient, that all assemblages are translucent to passage of X-rays and that any one of the pairs of flexion, neutral or lordosis blocks may be used as needed and with or without the support strap 55.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An assemblage for positioning and supporting a surgical patient, comprising:

a generally rectangular base block formed of resilient material having length, width and depth dimensions and a central opening;

a generally elongated U-shaped block formed of resilient material having a base and a pair of leg portions extending from said base defining a central opening and having length, width and depth dimensions;

means for releasably securing said U-shaped block and said base block one to the other with said U-shaped block superposed on said base block and said openings in registration one with the other;

a face and chest block formed of resilient material superposed at least in part on said base block adjacent the end of said U-shaped block remote from said base thereof for receiving the face and chest of the patient;

a pair of elongated blocks formed of resilient material superposed on the legs of said U-shaped blocks to define a space laterally therebetween in registry with the openings in said U-shaped block and said base block whereby the abdomen and diaphragm of the patient may depend freely in a direction toward said space and openings; and means for releasably securing said pair of blocks and said U-shaped block one to the other.

2. An assemblage according to claim 1 including an inside base filler block formed of resilient material and having a length less than the length of said base block opening, said filler block being disposed in the opening in said base block remote from the base of said U-shaped block and in part underlying a portion of said face and chest block, and means for releasably securing said filler block and said face and chest block on to the other.

3. An assemblage according to claim 1 including an outside base filler block formed of resilient material disposed adjacent one end of said base block and in part underlying said face and chest block, and means for releasably securing said outside base filler block and said face and chest block one to the other.

4. An assemblage according to claim 1 including a substantially rigid mounting board disposed to underlie said base block and means for releasably securing said base block and said board one to the other.

5. An assemblage according to claim 4 including an outside base filler block formed of resilient material disposed adjacent one end of said base block and underlying said face and chest block, means for releasably securing said outside base filler block and said face and chest block one to the other and means for releasably securing said outside filler block and said board one to the other.

6. An assemblage according to claim 5 wherein each of said releasable securing means comprises loop-and-pile connections between adjoining blocks, respectively, and the board and the blocks secured to the board, respectively.

7. An assemblage according to claim 1 wherein the upper margins of said U-shaped block about said opening taper inwardly and downwardly.

8. An assemblage according to claim 1 including an inside base filler block formed of resilient material and having a length less than the length of said base block opening, said filler block being disposed in the opening in said base block remote from the base of said U-shaped block and in part underlying a portion of said face and chest block, means for releasably securing said filler block and said face and chest block one to the other and an outside base filler block formed of resilient material disposed adjacent one end of said base block and in part underlying said face and chest block, and means for releasably securing said outside base filler block and said face and chest block one to the other.

9. An assemblage according to claim 8 including a second face and chest block formed of resilient material disposed over the first-mentioned face and chest block, and means for releasably securing said first and second face and chest blocks one to the other.

10. An assemblage according to claim 1 wherein each of said pair of blocks has an upper surface inclined inwardly and downwardly generally toward the opening in said U-shaped block.

11. An assemblage according to claim 10 wherein each of said pair of blocks has an arcuate upper surface extending in the longitudinal direction, said arcuate upper surface having convex and concave surface portions spaced longitudinally one from the other, said convex surface portion lying adjacent the base of said U-shaped block and said concave surface portion lying forwardly thereof in a direction toward said face and chest block.

12. An assemblage according to claim 11 wherein the highest point of the convex surface portion of each said pair of blocks lies at an elevation higher than any other point therealong.

13. An assemblage according to claim 10 wherein each of said pair of blocks has an arcuate convex upper surface extending in a longitudinal direction and substantially between the opposite ends thereof.

14. An assemblage according to claim 10 wherein each of said pair of blocks has a linear upper surface extending in a longitudinal direction.

15. An assemblage according to claim 1 including an inside base filler block formed of resilient material and having a length less than the length of said base block opening, said filler block being disposed in the opening in said base block remote from the base of said U-shaped block and in part underlying a portion of said face and chest block, means for releasably securing said filler block and said face and chest block one to the other, an outside base filler block formed of resilient material disposed adjacent one end of said base block and in part underlying said face and chest block, means for releasably securing said outside base filler block and said face and chest block one to the other, a second face and chest block formed of resilient material disposed over the first-mentioned face and chest block, and means for releasably securing said first and second face and chest blocks one to the other, each of said pair of blocks having an upper surface inclined inwardly and downwardly generally toward the opening in said U-shaped block.

16. An assemblage according to claim 2 wherein said inside base filler block has a depth dimension different than the depth dimension of said base block.

17. An assemblage according to claim 3 wherein said outside base filler block has a depth dimension different than the depth dimension of said base block.

18. An assemblage according to claim 1 including means adjacent the ends of the legs of said U-block for retaining said legs in predetermined positions spaced laterally one from the other and precluding said legs from substantially spreading apart when a patient lies on said assemblage.

19. Surgical support and positioning apparatus for a surgical patient, comprising:

a generally rectangular base block formed of resilient material having length, width and depth dimensions and a central opening;

a generally elongated U-shaped block formed of resilient material having a base and a pair of leg portions extending from said base defining a central opening and having length, width and depth dimensions;

means carried by at least one of said base block and said U-shaped block for releasably securing said base block and said U-shaped block one to the other, with the U-shaped block in superposition relative to the base block;

a face and chest block formed of resilient material for superposition at least in part on said base block adjacent the end of the U-shaped block remote from the base block for receiving the face and chest of the patient;

a pair of elongated blocks formed of resilient materials for superposition on the legs of said U-shaped block to define a space laterally therebetween in registry with the openings of the U-shaped block and the base block when the pair of blocks are superposed over the U-shaped block and the base block, each of said pair of blocks having an upper surface inclined generally inwardly and downwardly toward one another when superposed on the U-shaped block; and means carried by one of said U-shaped block and said pair of blocks for releasably securing said pair of blocks and said U-shaped block one to the other.

20. Apparatus according to claim 19 including an inside base filler block formed of resilient material and having a length less than the length of said base block opening, said filler block being adapted for disposition in the opening in said base block, and means carried by one of said inside base filler block and said face and chest block for releasably securing said filler block and said face and chest block one to the other.

21. Apparatus according to claim 19 including an outside base filler block formed of resilient material adapted for disposition adjacent one end of said base block, and means carried by one of said outside base filler block and said face and chest block for releasably securing said outside base filler block and said face and chest block one to the other.

22. Apparatus according to claim 19 including a substantially rigid mounting board adapted to underlie said base block and means carried by one of said board and said base block for releasably securing said base block and said board one to the other.

23. Apparatus according to claim 19 including a second face and chest block formed of resilient material and adapted for disposition over the first-mentioned face and chest block, and means carried by at least one of said face and chest blocks for releasably securing said first and second face and chest blocks on to the other.

24. Apparatus according to claim 19 wherein each of said pair of blocks has an upper surface inclined inwardly and downwardly, when disposed on the U-shaped block, generally toward the opening in said U-shaped block.

25. Apparatus according to claim 24 wherein each of said pair of blocks has an arcuate upper surface extending in the longitudinal direction, said arcuate upper surface having convex and concave surface portions spaced longitudinally one from the other.

26. Apparatus according to claim 24 wherein each of said pair of blocks has an arcuate convex upper surface extending in a longitudinal direction and substantially between the opposite ends thereof.

27. Apparatus according o claim 24 wherein each of said pair of blocks has a linear upper surface extending in a longitudinal direction.

28. Apparatus for positioning and supporting a surgical patient, comprising:

a generally elongated U-shaped block formed of resilient material having a base and a pair of leg portions extending from said base defining a central opening and having length, width and depth dimensions;

a substantially rigid mounting board disposed to underlie said U-shaped block and means for releasably securing said U-shaped block and said board one to the other;

a face and chest block formed of resilient material superposed at least in part on said board adjacent the end of said U-shaped block remote from said base thereof for receiving the face and chest of the patient;

means carried by said board and said face and chest block for releasably securing said face and chest block and said board one to the other;

a pair of elongated blocks formed of resilient material superposed on the legs of said U-shaped blocks to define a space laterally therebetween in registry with the opening in said U-shaped block and said base block whereby the abdomen and diaphragm of the patient may depend freely in a direction toward said space and opening; and means cooperable between said pair of blocks and said U-shaped block for releasably securing said pair of blocks and said U-shaped block one to the other.

29. Apparatus according to claim 28 wherein each of said pair of blocks has an upper surface inclined inwardly and downwardly generally toward the opening in said U-shaped block.

30. Apparatus according to claim 28 wherein each of said pair of blocks has an arcuate upper surface extending in the longitudinal direction, said arcuate upper surface having convex and concave surface portions spaced longitudinally one from the other, said convex surface portion lying adjacent the base of said U-shaped block and said concave surface portion lying forwardly thereof in a direction toward said face and chest block.

* * * * *